US006819890B1

(12) United States Patent
Bott et al.

(10) Patent No.: US 6,819,890 B1
(45) Date of Patent: Nov. 16, 2004

(54) CLOSED LOOP CONTROL OF NIP WIDTH IN A FUSER SYSTEM

(75) Inventors: Donald M. Bott, Rochester, NY (US); Steven M. Russel, Pittsford, NY (US); David P. Van Bortel, Victor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/739,027

(22) Filed: Dec. 19, 2003

(51) Int. Cl.[7] ..... G03G 15/20
(52) U.S. Cl. ..... 399/67
(58) Field of Search ..... 399/67, 68

(56) References Cited

U.S. PATENT DOCUMENTS

| | | | |
|---|---|---|---|
| 3,934,113 | A | 1/1976 | Bar-on |
| 4,042,804 | A | 8/1977 | Moser |
| 5,053,829 | A | 10/1991 | Field et al. |
| 5,436,711 | A | 7/1995 | Hauser |
| 5,998,761 | A | 12/1999 | Berkes et al. |
| 6,169,862 | B1 | 1/2001 | Abe et al. |
| 6,289,587 | B1 | 9/2001 | Battat et al. |

FOREIGN PATENT DOCUMENTS

| | | | | |
|---|---|---|---|---|
| JP | A 61-18982 | | 1/1986 | |
| JP | A 63-13088 | | 1/1988 | |
| JP | 10207318 A | * | 8/1998 | ..... G03G/21/14 |

* cited by examiner

*Primary Examiner*—Quana Grainger
(74) *Attorney, Agent, or Firm*—Oliff & Berridge, PLC

(57) ABSTRACT

A fuser system of a xerographic device includes at least one set of a fuser member and a pressure member having a nip width therebetween, the nip width being set to within a specification nip width range, at least one sensor for monitoring the velocity of at lease one of the fuser member, the pressure member and a media passing through the nip, a processor that receives the velocity data from the at least one sensor and that determines a current nip width from the velocity data and compares the current nip width to the specification nip width range, and a nip width adjustment device in communication with the processor, which adjusts the current nip width to be within the specification nip width range. To offset changes in nip width due to hardening/softening of a fuser member material, or to provide a means to measure nip width in order to enable fusing setpoints using multiple nip width specifications, a method for closed loop control of nip width is enabled by the fuser system.

20 Claims, 4 Drawing Sheets

CLOSED LOOP CONTROL OF NIP WIDTH IN A FUSER SYSTEM

BACKGROUND OF THE INVENTION

1. Field of Invention

This invention relates to a fuser system that includes a closed loop control that controls a fuser's nip width by monitoring a representative media or component velocity and enables appropriate adjustment of the nip width over time, and to a method of controlling the nip width in such fuser system.

2. Description of Related Art

In the art of xerography or other similar image reproducing arts, a latent electrostatic image is formed on a charge-retentive surface, i.e., a photoconductor or photoreceptor. To form an image on the charge-retentive surface, the surface is first provided with a uniform charge after which it is exposed to a light or other appropriate image of an original document to be reproduced. The latent electrostatic image thus formed is subsequently rendered visible by applying any one of numerous toners specifically designed for this purpose.

It should be understood that for the purposes of the present invention, the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. The particular method by which the image is formed is not critical to the present invention, and any such suitable method may be used.

In a typical xerographic device, the toner image formed is transferred to an image receiving substrate such as paper. After transfer to the image receiving substrate, the image is made to adhere to the substrate using a fuser apparatus. To date, the use of simultaneous heat and contact pressure for fusing toner images has been the most widely accepted commercially, the most common being systems that utilize a pair of pressure engaged rolls.

The use of pressure engaged rolls for fixing toner images is well known in the art. See, for example, U.S. Pat. Nos. 6,289,587, 5,998,761, 4,042,804 and 3,934,113.

At the time of initial set-up of a xerographic device, the fuser system is set to be within certain specifications for, e.g., dwell time (nip width/process speed), paper velocity and creep. Dwell time is one of the more significant drivers of image fix and quality. Paper velocity is an important factor in paper handling. Creep, which is the release surface's extension in the nip, is important with respect to enabling self-stripping of the paper from the fuser roll. These specifications are set by, for example, setting a roll rotation speed for the paper velocity and setting the nip width for the dwell time and creep.

Once initially set, the nip width of a typical fuser is not changed during operation of the xerographic device. Unfortunately, several internal and external factors can cause the fuser system to drift outside of the designated specifications. For example, in a typical soft-on-hard roll pair in which the soft roll is the driving roll, the fuser system may begin operating outside of specifications due to, e.g., hardening of the roll materials over time. Typical fuser roll systems include some materials such as silicone materials that tend to become harder over time at unpredictable rates.

This hardening causes large reductions in both dwell time and creep, which causes premature failure (e.g., smaller nip widths that lead to insufficient fixing of the toner image and/or poor image quality, as well as to poor stripping of the image receiving substrate).

In addition to these failure modes, it is at times desired that the nip width in a fuser be altered on demand. For instance, the fusing quality on thick paper is improved with large nip widths, and the fusing quality on thin papers is often improved with small nip widths. The fusing latitude in the presence of varied media and images, therefore, is improved if the nip width can be accurately set and controlled.

Typically, resetting the nip width to improve fusing latitude or to compensate for system failures due to the fuser system falling out of specifications has been dealt with by either (a) having a technician re-set the nip on site and/or (b) setting the nip width far above specifications at the factory, permitting the device to operate longer before falling out of specification. However, each of these 'solutions' has serious problems. Using technicians to reset the nip requires an on site visit by a technician and down time of the device. Initially setting the nip width high above specifications usually causes paper handling and stripping issues, especially with lightweight papers.

What is required is an improved inline method where the machine itself measures and adjusts the nip width to maintain the fuser system within operational specifications.

SUMMARY OF THE INVENTION

The present invention provides a fuser system of a xerographic device, comprising one or more sets of a fuser member and a pressure member in which the pressure member is made to exert pressure upon the fuser member so as to form a nip having a nip width between the fuser member and the pressure member, wherein the nip width is set to within a specification nip width range, at least one sensor for monitoring the velocity of the driven member or the velocity of a media passing through the nip, a processor in communication with the at least one sensor and that receives this velocity data from the at least one sensor, wherein the processor determines a current nip width from the velocity data and compares the current nip width to the specification nip width range, and a nip width adjustment device in communication with the processor, which adjusts the current nip width to be within the specification nip width range.

The present invention also provides a xerographic device comprising at least a toner image forming station, a transfer station to transfer the toner image to an image receiving substrate, and the fuser system of the invention to fix the toner image to the image receiving substrate.

The present invention also provides a method for closed loop control of a nip width associated with a set of a fuser member and a pressure member in which the pressure member is made to exert pressure upon the fuser member so as to form a nip having a nip width between the fuser member and the pressure member, wherein the nip width is set to within a specification nip width range, comprising monitoring the velocity of the driven member or the velocity of a media passing through the nip, providing this velocity to a processor, wherein the processor determines a current nip width from the roll velocity and compares the current nip width to the specification nip width range, and when the current nip width is outside the specification nip width range, adjusting the current nip width so as to be within the specification nip width range.

DETAILED DESCRIPTION OF PREFERRED EMBODIMENTS

As was discussed above, a typical xerographic machine includes at least a toner image forming station, a transfer station to transfer the toner image to an image receiving substrate, and a fuser system to fix the toner image to the image receiving substrate. At the toner image forming station, a latent image of an original image is developed, typically on the surface of a photoconductor or photoreceptor, using a suitable toner material. The developed toner image is then transferred to an image receiving substrate such as paper, a transparency, etc., at a transfer station. Following transfer to the image receiving substrate, the toner image must then be fixed to the image receiving substrate, which is done by a fuser system that applies heat and pressure to the substrate having the toner image thereon.

A fuser system of the present invention is comprised of a fuser member that may be comprised of, for example, a fuser roll, or a fuser belt traveling around one or more (fuser) rolls. The term "fuser member" as used herein collectively refers to any configuration of a fuser used to contact the toner image in fixing the toner image to the image receiving substrate. Similarly, the fuser system of the present invention is comprised of a pressure member that may be comprised of, for example, a pressure roll, or a pressure belt traveling around one or more rolls. The term "pressure member" as used herein collectively refers to any member loaded against the fuser member and used to apply pressure to the image and media passed between the fuser member and pressure member.

Figure 1:
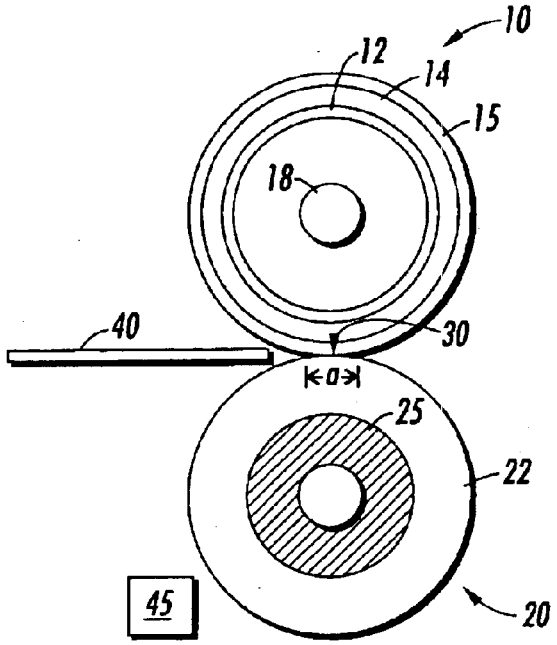
FIG. 1 illustrates a set of a fuser roll and a pressure roll for a xerographic device.

The fuser system preferably comprises a set of at least one pair of a fuser member, preferably a fuser roll, and a pressure member, preferably a roll. One set of rolls of the fuser system of the present invention is illustrated in FIG. 1. A fuser system may include one or more sets of fuser and pressure rolls, as appropriate. A system employing two sets of fuser and pressure rolls is described in U.S. Pat. No. 5,436,711, incorporated herein by reference. For ease of illustration and description, the present invention is described with respect to one set of fuser and pressure rolls in a roll only (non-belt) fuser system.

In the fuser system, the pressure roll 20 is brought to exert pressure upon fuser roll 10, thereby forming a nip 30 having a nip width "a" between the pressure roll and fuser roll. An image receiving substrate 40 having a toner image thereon is made to pass through the nip such that the toner image contacts the fuser roll surface. The toner image is fixed to the image receiving substrate via heat and pressure. As the image receiving substrate exits from the fuser system, the image receiving substrate is stripped from the fuser roll. Preferably, the stripping is a self-stripping, although stripping fingers or other stripping devices may also be used to assist in the stripping as is well known in the art.

The fuser member of the present invention may have any construction and design, without limitation. However, the invention as it relates to maintaining velocity over life is most applicable to fuser members having one or more layers thereof comprised of a material that has a tendency to harden over time. For example, such materials may include silicone materials, and thus the invention is most applicable to fuser members comprised of one or more layers of a silicone material.

In a preferred embodiment of the invention, the fuser member is a fuser roll that includes at least one layer including a silicone material. The fuser roll 10 preferably includes an outer layer 15 and an optional intermediate layer 14 upon suitable base member 12 which may be either a solid or hollow cylinder or core fabricated from any suitable metal such as aluminum, anodized aluminum, steel, nickel, copper, and the like. Hollow cylinders or cores are preferred as such can be heated from inside the cylinder or core. For example, a suitable heating element 18 may be disposed in the hollow portion of the cylinder or core. Alternatively, any suitable external heating option may also be used.

The outer layer 15 of the fuser member is preferably comprised of a fluoroelastomer, as conventional in the art. The fluoroelastomer may include a silicone material therein.

Suitable fluoroelastomers include FFKM elastomers and hydrofluoroelastomers. Illustrative FFKM elastomers are perfluororubbers of the polymethylene type having all substituent groups on the polymer chain either fluoro, perfluoroalkyl, or perfluoroalkoxy groups. The hydrofluoroelastomers (also known as FKM elastomers) are those defined in ASTM designation D1418-90 and are directed to fluororubbers of the polymethylene type having substituent fluoro and perfluoroalkyl or perfluoroalkoxy groups on a polymer chain.

The fluoroelastomers may be those described in detail in U.S. Pat. Nos. 4,257,699, 5,017,432 and 5,061,965. As described therein, these fluoroelastomers, particularly from the class of copolymers, terpolymers and tetrapolymers of vinylidenefluoride hexafluoropropylene, tetrafluoroethylene, and a cure site monomer (believed to contain bromine), are known commercially under various designations as the VITON™ line of fluoroelastomers available from E.I. DuPont de Nemours, Inc. Other commercially available materials include the FLUOREL™ line of fluoroelastomers available from 3M Company. Additional commercially available materials include AFLAS™ a poly (propylene-tetrafluoroethylene) copolymer, FLUOREL II™ a poly(propylene-tetrafluoroethylene-vinylidenefluoride) terpolymer both also available from 3M Company.

Fillers, for example alumina fillers, heat stabilizers, etc., may be included in the outer layer, as well known in the art. See, for example, U.S. Pat. Nos. 4,711,818 and 5,729,813.

The outer surface layer of the fuser member preferably has a thickness of from about 1 to about 9 mils.

One or more optional intermediate layers may be positioned between the substrate and the outer fluoropolymer/silicone layer. The intermediate layers preferably comprise a silicone rubber of a thickness so as to form a conformable layer. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as the SILASTIC™ line from Dow Coming and the RTV Silicone Rubber line from General Electric. Other suitable silicone materials include siloxanes (preferably polydimethylsiloxanes) such as fluorosilicones, dimethylsilicones, liquid silicone rubbers such as vinyl crosslinked heat curable rubbers or silanol room temperature crosslinked materials, and the like. Any suitable fillers may be included in the intermediate layer. In general, an intermediate layer preferably has a thickness of from about 0.05 to about 10 mm, preferably from about 0.1 to about 7 mm, and preferably from about 1 to about 5 mm.

Other layers such as adhesive layers or other suitable layers may be incorporated between the outer layer and the intermediate layer in embodiments, or between the substrate and the intermediate layer in embodiments.

Optionally, a delivery system including a sump containing release agents may be associated with the fuser roll so as to be able to apply release agents to the outer surface of the fuser roll.

Backup or pressure roll 20 cooperates with fuser roll 10 to form the nip 30. The pressure roll preferably comprises a rigid hollow steel (or other suitable hard material) core 25 with a soft surface layer 22 thereon.

The fuser member preferably exhibits an initial hardness of from about 30 to about 120 Shore A, preferably from about 40 to about 90 Shore A. Over time, materials of the fuser member such as silicone materials tend to harden. This hardening may cause an increase in hardness of 20 or more Shore A units, which is problematic as fuser member hardness changes of as little as 5 Shore A units can cause the fuser member to fall out of specification. This is because the fuser member hardness directly impacts the nip width. As the fuser member becomes harder, the nip width decreases, leading to failure of image fix and stripping.

At the time of initial set-up of a xerographic device containing the fuser system, numerous specifications are implemented in the fuser system. Significant specifications in the fuser system include dwell time, (nip width and process speed), paper velocity and creep. The operational specification nip width range for the fuser system varies depending on the geometry of the fuser system, but the appropriate operational range may be readily determined by one of ordinary skill in the art knowing the geometry of the system. For example, the nip width may have an operational specification range of from about 13.0 to about 17.5 mm.

As nip width can change over time as discussed above, the nip width may drift out of the specification range upon hardening of materials of the fuser member. Also, as creep is the release surface's extension in the nip, this may also change over time upon hardening of materials of the fuser member and fall out of specification, leading to failure in the stripping of the image receiving substrate from the fuser roll.

Additionally, internal or external factors may require the nip width of the operating fuser to be adjusted to a new specification range. For example, the fusing of thick paper might change the operational specification range from about 13 to about 17.5 mm to about 17 to about 21 mm.

In the present invention, nip width and/or a property from which the nip width can be derived is monitored. The monitoring device provides the measured values for the property to a processor, which then compares the measured/determined current nip width of the fuser member to the required specification nip width. If the current nip width is determined to be out of an acceptable specification range, the processor then signals a nip width adjustment device to appropriately adjust the pressure applied by the pressure roll against the fuser member, thereby adjusting the nip width to bring the nip width back into the appropriate specification range.

Although the monitoring device may be a sensor for any of numerous values within the fuser system, for example for directly monitoring nip width or indirectly monitoring indicators of nip width such as paper speed exiting from the fuser system, paper buckle prior to entering the fuser system, fuser roll to pressure roll center-to-center distribution, etc., it is most preferred in the present invention for the sensor to measure a velocity within the system from which nip width can be derived. In this regard, the velocity of a driven member of the fuser system, e.g., the pressure member or fuser member, and/or the velocity of media exiting from the nip of the fuser system is measured. In a most preferred embodiment, the pressure member is driven in the operation of the fuser system, and the the sensor measures the velocity of the pressure member. Directly sensing the nip width is extremely difficult and subject to inaccuracy.

Because the pressure member velocity bears a direct relationship to the nip width for a given fuser, measuring the pressure member velocity is the most reliable and efficient method for indirectly determining the current nip width of the fuser system. As the nip width decreases, either because of deterioration of a fusing member or because of a change in setpoint specifications, the pressure member velocity also decreases.

Figure 2:
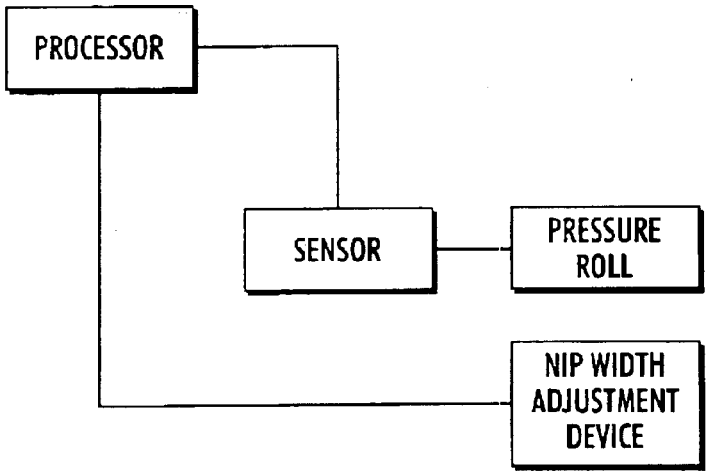
FIG. 2 illustrates the cooperative relationship between a sensor, pressure roll, processor and nip width adjustment device.

The relationship between the monitoring sensor, the pressure roll, the processor and the nip width adjustment device is shown in FIG. 2. The monitoring sensor is labeled as 45 in FIG. 1.

Any suitable sensor known in the sensing art may be used, without limitation, to monitor the velocity, e.g., the velocity of the pressure roll (driven member) and/or the velocity of media exiting from the fuser system. For a sensor measuring the velocity of a pressure roll, the sensor may be located either internal within the pressure roll or external to the pressure roll. For ease in maintenance and replacement, the sensor is preferably located external to the pressure roll.

The monitoring sensor is in communication with a processor so that the data measured by the sensor may be sent to the processor. Although wireless communication is possible, it is typically suitable to use conventional cabling between the sensor and the processor in order for the processor to be able to reliably receive the data from the monitoring sensor.

The processor evaluates the received data to determine a value for the measured, or current, nip width of the fuser system. Where the data is of the pressure roll velocity, the data is converted to a nip width value by the processor. This can be done by any suitable means, for example through use of a lookup table stored in the processor. Such a lookup table can store the nip widths corresponding to various pressure roll velocities for the given geometry of the fuser system. The processor may also calculate the current nip width value from the pressure roll velocity data using an appropriate function equation stored in the processor.

Once the current nip width is determined, it is compared against the nip width specification range required of the fuser system in order to operate properly without failures. If the current nip width is determined to be outside of the nip width specification range, then the processor signals a nip width adjustment device to appropriately adjust the load in the fuser system, i.e., adjust the amount of pressure exerted by the pressure roll against the fuser member.

For example, in the event materials of the fuser member have hardened such that the current nip width has been reduced to fall outside of the nip width specification range, a nip width adjustment device is signaled to increase the load on the system, thereby increasing the pressure exerted by the pressure roll against the fuser member so that the nip width is increased to again fall within the desired operational specification range. By increasing the load, one can increase the nip width and dwell to be within the specifications, which has the benefit of also correcting any drift in the paper velocity that may have occurred.

The nip width adjustment device can be designed to adjust, for example increase, the fuser load in situ in the closed loop process of the present invention by any suitable means. Preferably, the load can be adjusted by changing a total cam lift, a spring preload, or any other physical displacement, in the loading mechanism. The loading mechanism is preferably associated with a mounting structure for the pressure roll of the fuser system.

The fuser system of a xerographic device of the present invention thus includes a nip width adjustment device in communication with the processor, which can adjust the current nip width by adjusting the load in the fuser system. It is most preferable for the nip width adjustment device to be associated with the pressure roll in order to be able to adjust the load in the fuser system. For example, the nip width adjustment device may be associated with the mounting structure of the pressure roll within the xerographic device.

In embodiments, the nip width adjustment device is preferably associated with the pressure roll in such a way that the pressure exerted by the pressure roll upon the fuser member may be adjusted, for example adjusted to increase the pressure exerted by the pressure roll upon a detection that the nip width has decreased due to, for example, silicone hardening.

As the nip width adjustment device, any arrangement capable of effecting the adjustment of the load, e.g., effecting an increase in the pressure exerted by the pressure roll against the fuser member, can be used without limitation. For example, any device that can be adjusted to effect a physical displacement of the pressure roll with respect to the fuser member can be used. Preferably, the nip width adjustment device is associated with a movable mounting structure of the pressure roll, such that the nip width adjustment device can be made to adjust the location of the pressure roll mounting structure, which correspondingly adjusts the extent of pressure between the pressure roll and the fuser member.

FIGS. 3-6 illustrate four possible nip width adjustment device arrangements that may be used in the present invention.

Figure 3:
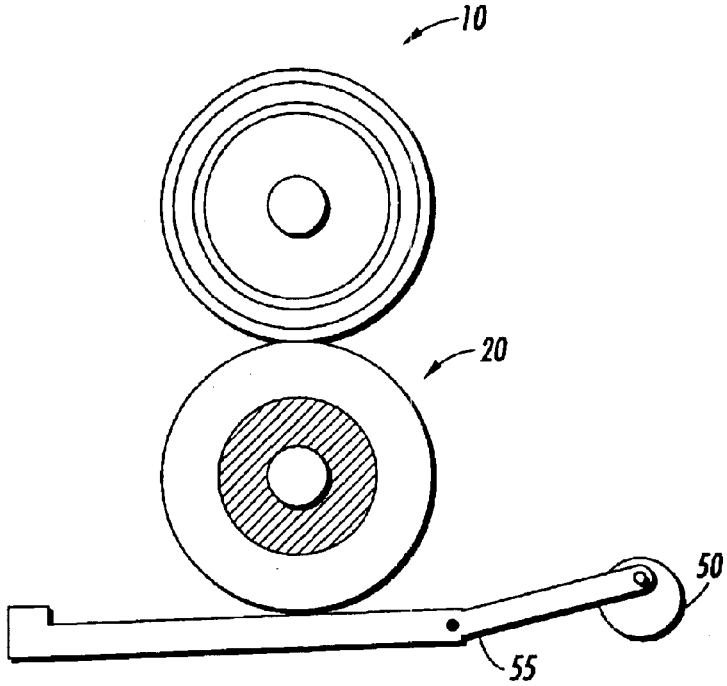
FIG. 3 illustrates a mounting structure for a pressure roll in which the pressure exerted upon the fuser member is adjustable with a cam and cam follower.

In a preferred embodiment, the pressure exerted upon the fuser member by the pressure roll is adjustable with a cam and cam follower in the mounting structure of the pressure roll. This embodiment is illustrated in FIG. 3. As shown, the cam 50, external to the pressure roll 20, is linked to a cam follower 55. The cam follower, in turn, is linked to the pressure roll, either directly or through a mounting structure that might include springs.. Upon appropriate rotation of the cam, the cam follower is made to put more load upon the pressure roll, thereby causing the pressure roll to increase the amount of pressure exerted upon the fuser member 10. The link between the cam and cam follower need not be direct as shown in FIG. 3, but may alternatively be made through an additional arm, with or without a spring associated with the additional arm. The rotation of the cam can readily be controlled by the processor, as readily understood by one of ordinary skill in the art.

Figure 4:
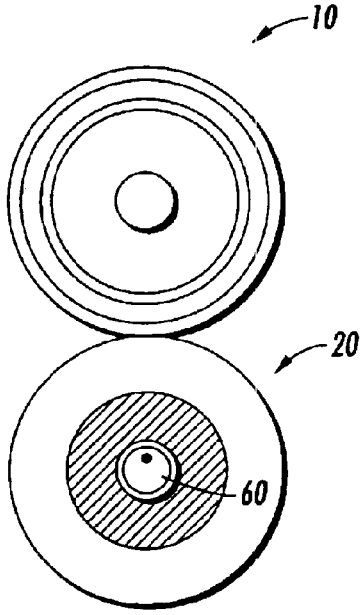
FIG. 4 illustrates a mounting structure for a pressure roll in which the pressure exerted upon the fuser member is adjustable with a rotary cam.

Another nip width adjustment device structure is shown in FIG. 4. In this embodiment, the pressure exerted upon the fuser roll by the pressure roll is adjustable with a rotary cam 60. The rotary cam is illustrated to be within the pressure roll 20 in FIG. 4, but alternative arrangements may be used without limitation. As in the embodiment discussed above, upon appropriate rotation of the rotary cam, the position of the pressure roll is adjusted. Thus, appropriate rotation of the rotary cam can move the pressure roll toward the fuser member, thereby increasing the amount of pressure exerted by the pressure roll upon the fuser member. Control of the rotary cam by the processor may be implemented by any means well known in the art.

Figure 5:
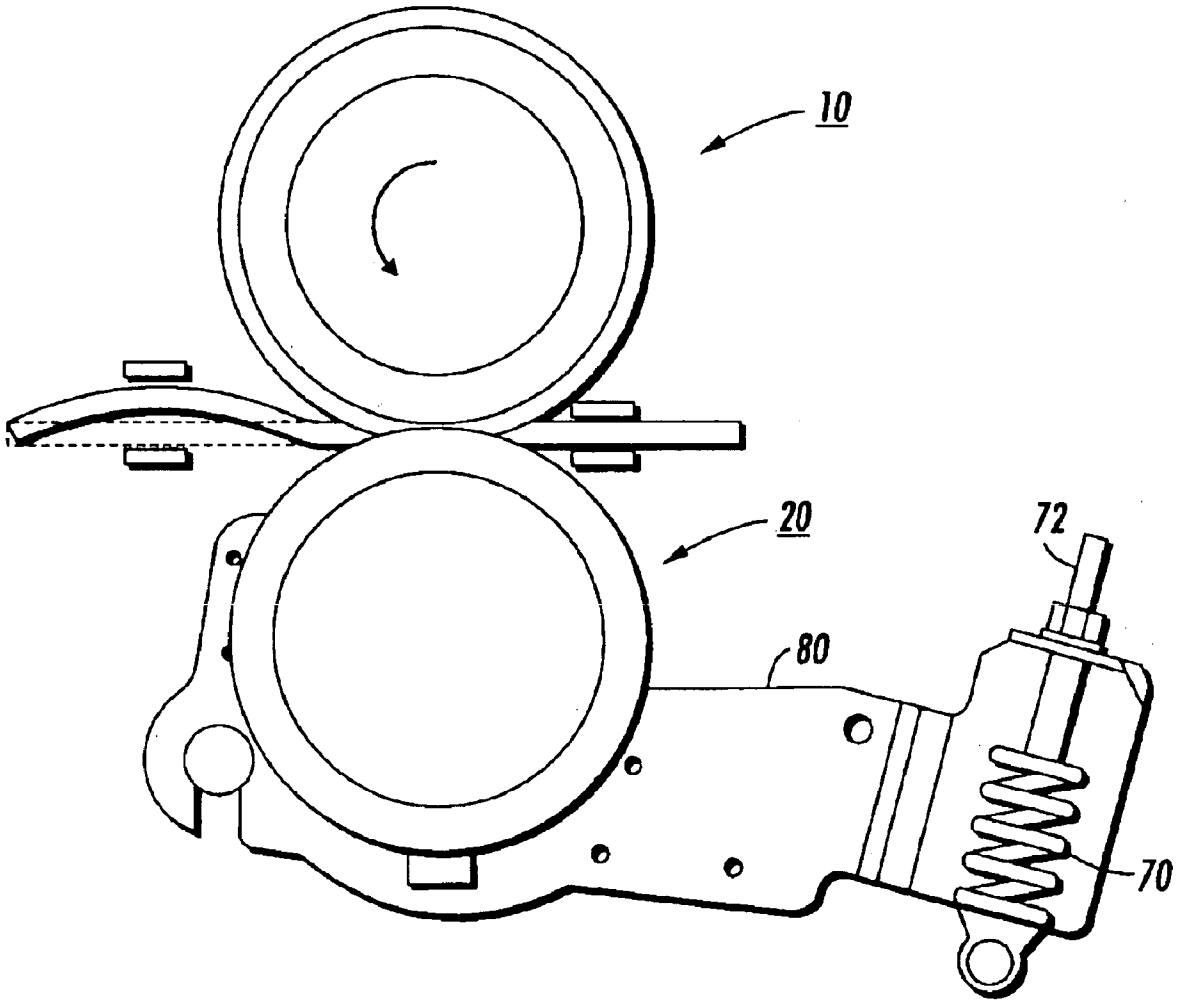
FIG. 5 illustrates a mounting structure for a pressure roll in which the pressure exerted upon the fuser member is adjustable with a spring.

FIG. 5 shows a still further arrangement for the nip width adjustment device of the present invention. FIG. 5 illustrates a mounting structure for a pressure roll in which the pressure exerted upon the fuser member is adjustable with a spring. The load on the spring may be adjusted in any suitable manner, thereby increasing the load upon the pressure member. For example, the spring may be compressed by turning a top screw to increase the load. Also, the spring 70 may be in association with a loading mechanism such as a rotating cam of the xerographic device, as well as in association with the movable mounting structure 80 of the pressure roll 20. With this arrangement, increasing the compression of the spring can force the pressure roll closer to the fuser member, thereby increasing the amount of pressure exerted by the pressure roll upon the fuser member and correspondingly increasing the nip width.

In a preferred arrangement of the spring mechanism, the spring is associated with a screw mechanism 72, e.g., provided around the outside of a screw. Tightening of the screw increases the compression of the spring, thereby resulting in the physical displacement discussed above. Alternatively, the spring may simply be made to contact the pressure roll mounting structure on a part of the structure opposite the fuser member, with a plate (or other suitable means that may be pressed) at the end of the spring opposite the end contacting the pressure roll mounting structure. With this arrangement, more pressure may be made to be exerted upon the spring by a pressing force against the plate, thereby increasing the compression on the spring and resulting in the desired increase in pressure exerted by the pressure roll against the fuser member and, in turn, in the desired increase in nip width.

Figure 6:
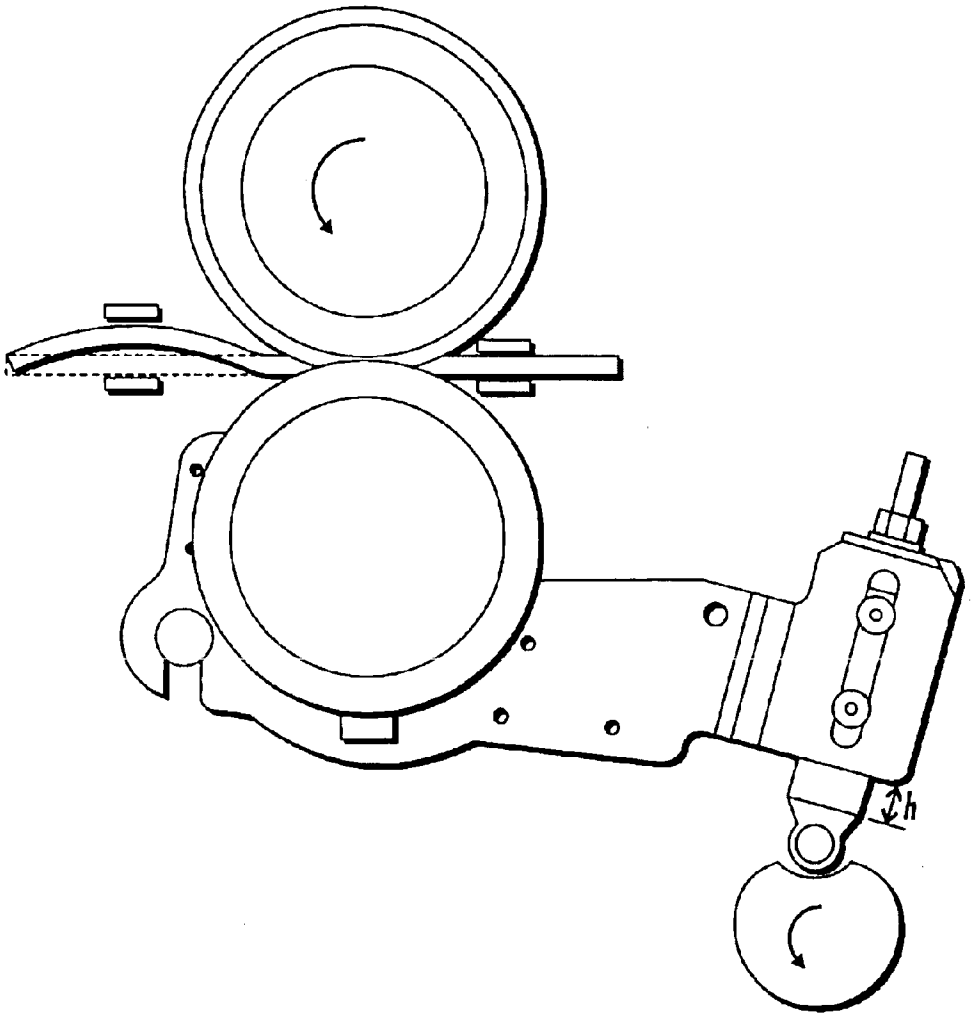
FIG. 6 illustrates a mounting structure for a pressure roll in which the pressure exerted upon the fuser member is adjustable with a shim.

A still further embodiment of the nip width adjustment device is illustrated in FIG. 6. FIG. 6 illustrates a mounting structure for a pressure roll in which the pressure exerted upon the fuser member is adjustable with a shim. The shim may be adjusted to physically adjust the loaded position of the pressure roll, or a spring loading the pressure roll, thereby resulting in the desired adjustment of the load. As shown in FIG. 6, the shim may be used to adjust any physical dimension on the loading mechanism or frame. For example, the length h may be increased in a suitable fashion, e.g., with a screw mechanism, in order to increase the load on the pressure roll, while decreasing h lessens the load. The automated shim may be controlled by the processor using any means well known in the art.

The invention thus enables the fuser latitude to be increased, and fuser life to be lengthened and maintenance upon the fuser to be reduced as a result of automating the nip width adjustment of the fuser. The nip width is adjusted to maximize fusing performance over life, and monitored so that as, e.g., the fuser hardens over time and use, the nip width can be appropriately adjusted, by the xerographic device itself, and thus image quality, stripping, etc., does not suffer.

Having described preferred embodiments of the present invention (which are intended to be illustrative and not limiting), it is noted that modifications and variations can be made by persons of ordinary skill in the art in light of the above teachings. It is therefore to be understood that changes may be made in the particular embodiments of the invention disclosed which are within the scope and spirit of the invention as defined by the appended claims.

What is claimed is:

1. A fuser system of a xerographic device, comprising one or more sets of a fuser member and a pressure member in which the pressure member is made to exert pressure upon the fuser member so as to form a nip having a nip width between the fuser member and the pressure member, wherein the nip width is set to within a specification nip width range, at least one sensor for monitoring the velocity of at least one of the fuser member, the pressure member and a media passing through the nip, a processor in communication with the at least one sensor and that receives velocity data from the at least one sensor, wherein the processor determines a current nip width from the velocity data and compares the current nip width to the specification nip width range, and a nip width adjustment device in communication with the processor, which adjusts the current nip width to be within the specification nip width range.

2. The fuser system according to claim 1, wherein the fuser member is a fuser roll.

3. The fuser system according to claim 1, wherein the fuser member includes one or more layers of a silicone material.

4. The fuser system according to claim 1, wherein the pressure member is a pressure roll.

5. The fuser system according to claim 1, wherein the sensor monitors the velocity of the pressure member.

6. The fuser system according to claim 1, wherein the fuser system includes at least two sets each of a fuser member and a pressure member.

7. The fuser system according to claim 1, wherein the nip width adjustment device is in a mounting structure of the pressure member.

8. The fuser system according to claim 1, wherein the nip width adjustment device comprises an adjustable spring.

9. The fuser system according to claim 8, wherein the adjustable spring is adjustable with a screw.

10. The fuser system according to claim 1, wherein the nip width adjustment device comprises a cam system.

11. The fuser system according to claim 10, wherein the cam system comprises a cam and cam follower.

12. The fuser system according to claim 10, wherein the cam system comprises a rotary cam.

13. The fuser system according to claim 1, wherein the nip width adjustment device comprises a mechanism of a mounting structure of the pressure roll that adjusts the mounting structure so that the pressure roll is made to move toward or away from the fuser member.

14. The fuser system according to claim 13, wherein the mechanism is a shim.

15. A xerographic device comprising at least a toner image forming station, a transfer station to transfer the toner image to an image receiving substrate, and the fuser system of claim 1 to fix the toner image to the image receiving substrate.

16. A method for closed loop control of a nip width associated with a set of a fuser member and a pressure member in which the pressure member is made to exert pressure upon the fuser member so as to form a nip having a nip width between the fuser member and the pressure member, wherein the nip width is set to within a specification nip width range, comprising monitoring velocity of at least one of the fuser member, the pressure member and a media passing through the nip, providing the velocity to a processor, wherein the processor determines a current nip width from the velocity and compares the current nip width to the specification nip width range, and when the current nip width is outside the specification nip width range, adjusting the current nip width so as to be within the specification nip width range.

17. The method according to claim 16, wherein the adjusting comprises increasing the pressure exerted by the pressure member upon the fuser member.

18. The method according to claim 16, wherein the adjusting comprises adjusting load on a spring controlling a force exerted by the pressure member upon the fuser member.

19. The method according to claim 16, wherein the adjusting comprises adjusting a cam controlling a force exerted by the pressure member upon the fuser member.

20. The method according to claim 16, wherein the adjusting comprises adjusting a shim controlling a force exerted by the pressure member upon the fuser member.

* * * * *